US006201222B1

(12) United States Patent
Baker et al.

(10) Patent No.: US 6,201,222 B1
(45) Date of Patent: Mar. 13, 2001

(54) METHOD AND APPARATUS FOR PREHEATING AN OVEN

(75) Inventors: Richard L. Baker, Lewisburg; Marvin L. DeBeque, Huber Heights, both of OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/268,415

(22) Filed: Mar. 15, 1999

(51) Int. Cl.[7] ..... H05B 1/02

(52) U.S. Cl. ..... 219/497; 219/492; 219/506; 219/412; 219/414

(58) Field of Search ..... 219/497, 506, 219/492, 505, 412–414, 483–486

(56) References Cited

U.S. PATENT DOCUMENTS

| | | | |
|---|---|---|---|
| 3,125,659 | 3/1964 | Welch | 219/20 |
| 3,329,802 | 7/1967 | Vogt | 219/413 |
| 3,604,896 | 9/1971 | Anderson | 219/411 |
| 3,627,987 | 12/1971 | Holtkamp | 219/511 |
| 4,292,501 | 9/1981 | Maitenaz | 219/413 |
| 4,461,951 * | 7/1984 | Luoma, II et al. | 219/497 |
| 4,481,787 | 11/1984 | Lynch | 236/46 R |
| 4,740,664 * | 4/1988 | Payne et al. | 219/449 |
| 5,622,640 | 4/1997 | Yoshida | 219/497 |
| 6,006,997 * | 12/1999 | Pfister et al. | 237/2 A |

* cited by examiner

*Primary Examiner*—Mark Paschall
(74) *Attorney, Agent, or Firm*—Robert O. Rice; Joel M. Van Winkle; Stephen D. Krefman

(57) ABSTRACT

A method for controlling the operation of an oven during preheating wherein the oven includes an oven cavity having an interior with at least one heating element for raising the temperature within the oven cavity and a temperature sensor provided for sensing the temperature within the oven cavity. The method of the present invention includes the steps of sensing the temperature within the oven cavity a plurality of times during the preheating period of the oven cycle, calculating the temperature rise within the oven cavity during the preheating period, and cycling the at least one heating element on and off during the preheating period such that the temperature rise within the oven cavity during the preheating period is controlled to match a predetermined temperature rise slope.

8 Claims, 3 Drawing Sheets

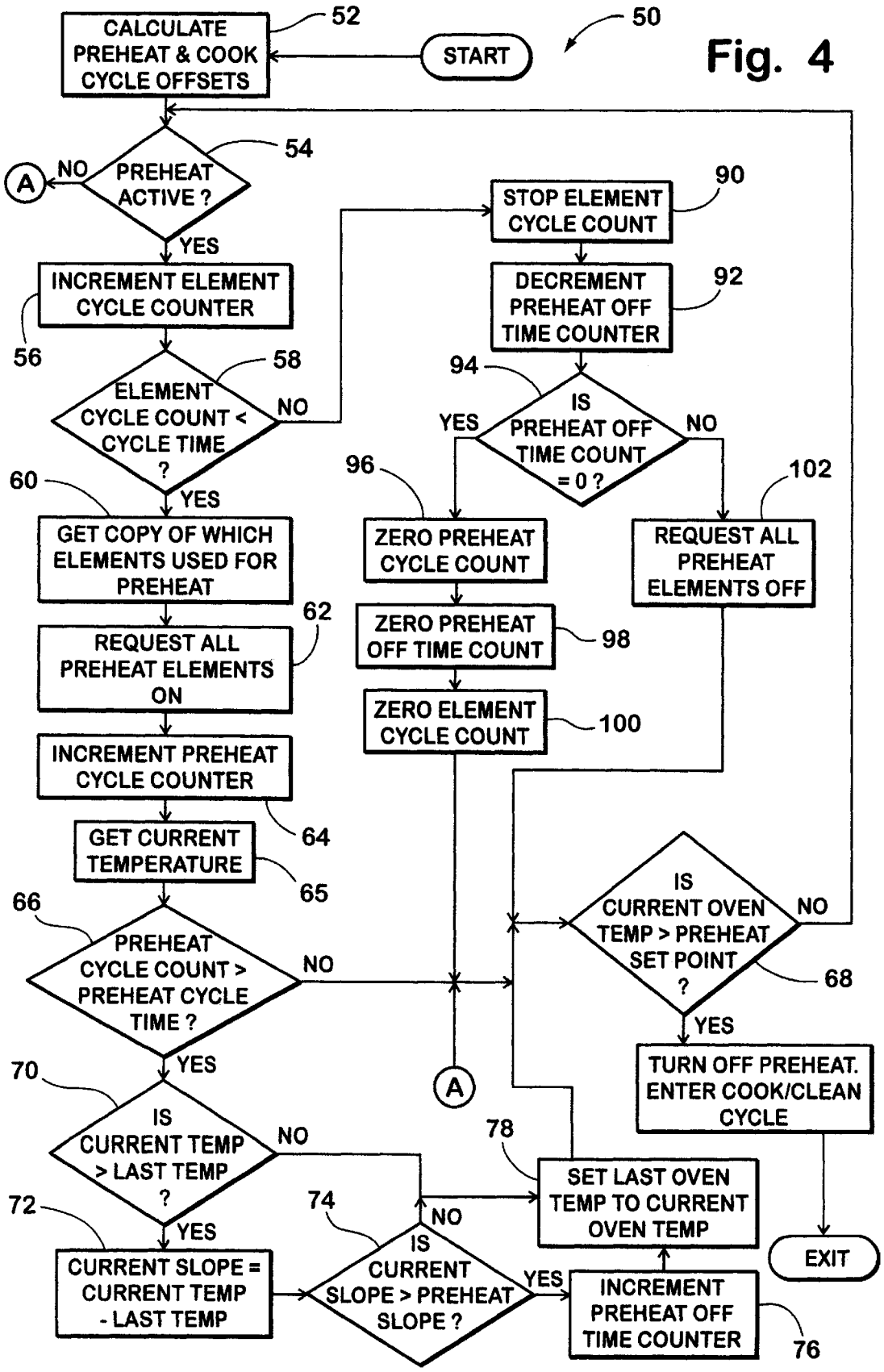
50
Fig. 4
START
CALCULATE PREHEAT & COOK CYCLE OFFSETS
52
PREHEAT ACTIVE ?
54
NO
A
YES
INCREMENT ELEMENT CYCLE COUNTER
56
ELEMENT CYCLE COUNT < CYCLE TIME ?
58
NO
YES
60
GET COPY OF WHICH ELEMENTS USED FOR PREHEAT
REQUEST ALL PREHEAT ELEMENTS ON
62
INCREMENT PREHEAT CYCLE COUNTER
64
GET CURRENT TEMPERATURE
65
66
PREHEAT CYCLE COUNT > PREHEAT CYCLE TIME ?
NO
YES
70
IS CURRENT TEMP > LAST TEMP ?
NO
YES
72
CURRENT SLOPE = CURRENT TEMP - LAST TEMP
74
IS CURRENT SLOPE > PREHEAT SLOPE ?
NO
YES
INCREMENT PREHEAT OFF TIME COUNTER
76
78
SET LAST OVEN TEMP TO CURRENT OVEN TEMP
STOP ELEMENT CYCLE COUNT
90
DECREMENT PREHEAT OFF TIME COUNTER
92
94
IS PREHEAT OFF TIME COUNT = 0 ?
YES
NO
96
ZERO PREHEAT CYCLE COUNT
ZERO PREHEAT OFF TIME COUNT
98
ZERO ELEMENT CYCLE COUNT
100
102
REQUEST ALL PREHEAT ELEMENTS OFF
IS CURRENT OVEN TEMP > PREHEAT SET POINT ?
NO
68
YES
TURN OFF PREHEAT. ENTER COOK/CLEAN CYCLE
EXIT
A

METHOD AND APPARATUS FOR PREHEATING AN OVEN

BACKGROUND OF THE INVENTION

1. Field of the Invention

The present invention generally relates to temperature control systems and methods, and more particularly, to a preheat oven control system and method.

2. Description of the Related Art

Conventional ovens employ electric resistance heaters or heating elements in an oven cavity for baking and cooking foods. Typically, at least one heating element, referred to as a bake element, is disposed adjacent the bottom of the oven cavity. Oven cavities are generally constructed out of steel with a porcelain coating finish. As is known, the heating elements are energized to heat the oven cavity and can be controlled to achieve a plurality of different operating modes. For example, an oven may be operated in a BAKE mode or a CLEAN mode. During each of these modes, the one or more heating elements are energized to raise the temperature of the oven to a pre-determined or pre-selected temperature and then the oven cavity is maintained at the desired temperature for a period of time.

One concern in the design of ovens is to ensure that the heating elements are not orientated or operated in a manner to cause the portions of the oven cavity nearest the heating elements to experience extremely high temperatures. The surface temperature of a heating element when energized is generally within the range of 1000–2000° F.—depending on the wattage density of the heating element. The porcelain finish on oven cavity walls can be degraded as a result of high temperatures and the related thermal expansion. This degradation is commonly referred to as porcelain "crazing" and is likely to occur if the oven cavity walls reach or exceed a temperature of 1000° F. Accordingly, ovens must be designed so that the oven cavity walls are not subject to high temperatures which may result in porcelain crazing.

Generally it is only during the initial preheat operation of an oven for a BAKE or CLEAN mode, when the oven is heating up to the desired temperature and when the heating elements are being continuously energized that there is a risk of porcelain crazing. The maximum temperature for a typical oven is around 850–900° F.—and this high temperature is only achieved during a CLEAN mode. During a BAKE mode, the oven is operated at much lower temperatures. Accordingly, it is only those portions of the oven cavity which are relatively close to the heating elements that run the risk of seeing temperatures exceeding 1000° F. during a preheat period.

Many ovens avoid porcelain crazing during preheating by spacing the heating elements, and particularly the bake element, an appropriate distance above the bottom wall of the oven cavity. In this manner, even if a bake element is energized continuously for a relatively long preheat period, the oven cavity directly beneath the bake element still does not exceed 1000° F.

Some oven designs, however, utilize an oven configuration wherein the bottom heating element or bake element is disposed in a separate compartment provided below the oven cavity, such as shown in U.S. Application Ser. No. 08/969,801, to Crone et al., entitled "HEATING ELEMENT SUPPORT SYSTEM FOR OVEN". These types of oven configurations may be referred to as hidden element ovens. In hidden element ovens, heat from the hidden heating element is transferred to the underside of the bottom wall of the oven cavity and is conducted throughout the entire oven cavity body and is radiated into the cavity from all of the interior oven cavity surfaces in a relatively even manner. This results in uniform heating of the oven cavity which can enhance the cooking performance of the oven. As can be readily appreciated, to achieve high efficiency in a hidden element oven, it is desirable to locate the bottom heating element close to the bottom wall of the oven cavity. This configuration, however, leads to the potential problem of porcelain crazing on the bottom wall of the oven—particularly during a preheat routine where the bake element may be energized continuously for a lengthy period.

Another way conventional ovens avoid the problems of overheating the oven liner adjacent the heating elements is to limit the watt density of the one or more heating elements. However, as can readily be appreciated, limiting the watt density of a heating element is a relatively unsophisticated method of dealing with this problem and can lead to poor performance when the line voltage supplied to the oven is lower than the target 240 V.A.C.—a situation which commonly occurs.

In addition to porcelain degradation, there is at least one additional problem which can arise during the preheat operation of a CLEAN mode. The object of a CLEAN mode is to raise the temperature of an oven cavity sufficiently to bum off food soils which have collected in the oven cavity. However, too rapid a temperature rise within the oven cavity can result in undesirable combustion and rapid expansion of gas within the oven cavity. U.S. Pat. No. 3,627,987 discloses one control method utilized to control oven cavity temperatures during the preheating of a CLEAN cycle. In the '987 patent, a thermal cycling switch is used to interrupt the energization of a heating element within an oven cavity such that the heat output of the heating element is reduced.

SUMMARY OF THE INVENTION

In view of the problems discussed above, one object of the present invention is to control the heating of an oven cavity, and in particular the preheating of an oven cavity, such that problems such as porcelain crazing and food soil combustion are avoided.

Another object is to control the preheating of an oven cavity to ensure uniform and consistent heating throughout the oven cavity.

Still another object of the present invention is to control the preheating and operation of an oven in a manner which is independent of the supplied line voltage such that the time for preheating an oven cavity does not vary depending on the supplied line voltage.

Still another object is to provide an oven control system which addressed the need for a controlled temperature rise preheat routine in an oven and allowed for rapid heating of an oven cavity with only the minimum necessary heating element cycling.

According to the present invention, the foregoing and other objects are attained by oven control method for controlling the operation of an oven during a preheating period of oven operation. The oven of the present invention includes an oven cavity having an interior with at least one heating element for raising the temperature within the oven cavity. A temperature sensor is provided for sensing the temperature within the oven cavity. The control method of the present invention includes the steps of sensing the temperature within the oven cavity a plurality of times during the preheating period of the oven cycle, calculating the temperature rise within the oven cavity during the preheating period, and cycling the at least one heating element on and off during the preheating period such that the temperature rise within the oven cavity during the preheating period is controlled to match a predetermined temperature rise slope. The present invention method further includes cycling the at least one heating element on and off during the preheating period to prevent the temperature rise within the oven cavity from exceeding the predetermined temperature rise slope.

In accordance with another feature of the present invention, a method for controlling the operation of an oven during the preheating period of the oven operation includes the steps of: sensing the temperature within the oven cavity to determine a first temperature within the oven cavity during the preheating period; sensing the temperature within the oven cavity to determine a second temperature within the oven cavity a predetermined time following the first temperature measurement; calculating an actual slope value corresponding to the difference between the second temperature and the first temperature; comparing the calculated actual slope value to a predetermined desired slope value corresponding to the predetermined temperature rise slope; and de-energizing the at least one heating element if the calculated value is greater than the predetermined desired slope value.

BRIEF DESCRIPTION OF THE DRAWINGS

FIG. 4 illustrates a flowchart of the operational functions in the preheat routine in accordance with the principles of the present invention.

DESCRIPTION OF THE PREFERRED EMBODIMENT

Figure 1:
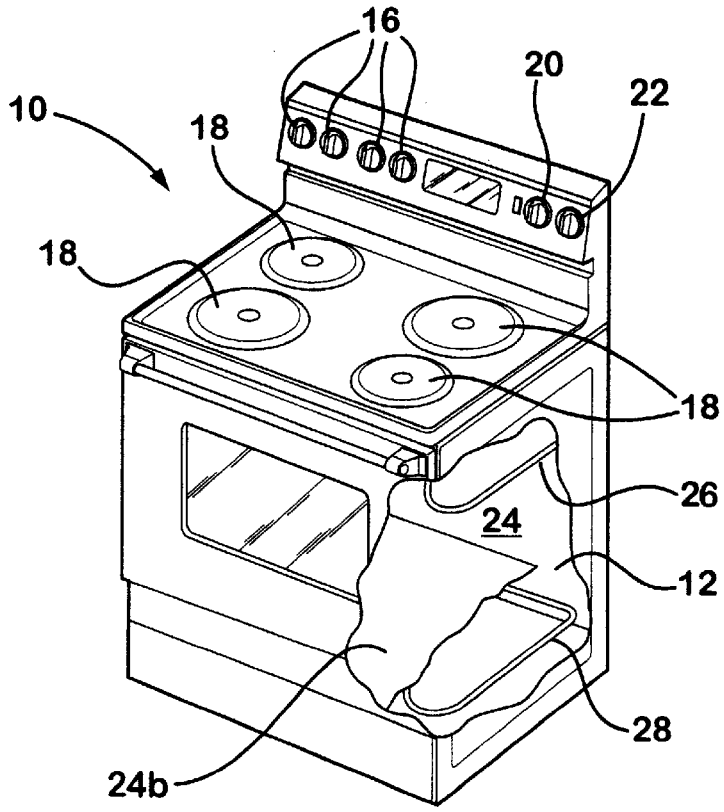
FIG. 1 illustrates a self-cleaning electric range having an oven adapted to be controlled by an oven preheat control system and method in accordance with the principles of the present invention.
Figure 2:
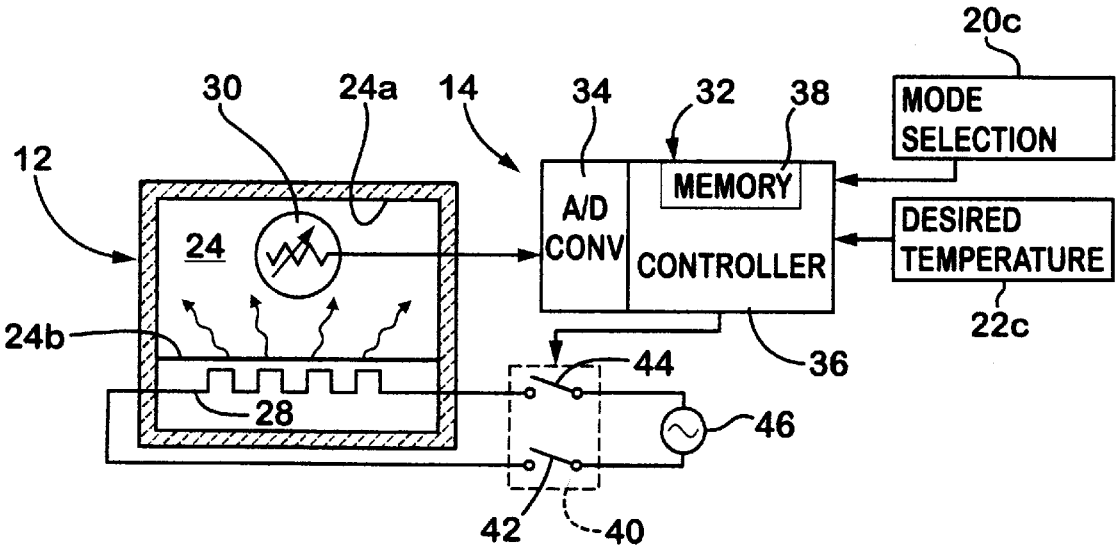
FIG. 2 illustrates a schematic view of an electronic microprocessor based oven temperature control system designed to be operated in accordance with the principles of the present invention.

Referring to the drawings and specifically to FIGS. 1 and 2, an electric range 10 is generally illustrated having a self-cleaning oven 12 adapted to be controlled by a microprocessor based control system 14 and a method in accordance with the principles of the present invention. Although an electric range 10 is illustrated, it should be understood that a gas range may implement the features of the present invention.

The range 10 includes a plurality of control knobs 16 for controlling a respective plurality of conventional electric (or gas) burners 18. In addition, the range 10 includes a control knob 20 for controlling a mode of operation of the oven 12. For example an OFF mode, a BAKE mode, a BROIL mode, and a CLEAN mode of operation may be selected by the control knob 20. In addition, a control knob 22 is conventionally provided to select a desired oven temperature within the oven 12.

The oven 12 includes an interior cavity 24 having a top wall 24*a* and a bottom wall 24*b*. A broiling element 26 may be disposed within the upper portion of the cavity 24 relatively close to the top wall 24*a*. A bake element 28 is disposed beneath the bottom wall 24*b* in a bottom heating cavity 29 in a similar manner to the configuration shown in U.S. Application Ser. No. 08/969,801, to Crone et al., herein incorporated by reference. The bake element 28 is disposed relatively close to the bottom wall 24*b* to promote efficient heat transfer and to allow for a maximum oven cavity size.

Positioned within the cavity 24 of the oven 12 is a temperature sensor such as an oven temperature-sensing probe. While two heating elements are shown in FIG. 1, it can be readily appreciated that the present invention can be practiced in an oven having only one or more than two heating elements.

The microprocessor based control system 14 includes a microprocessor 32 suitably programmed to affect the desired control of the range 10 in accordance with the selected mode. More particularly, the oven 12 may be suitably controlled during a preheat routine at the initiation of the one or all of the BAKE, BROIL or CLEAN modes of operation in accordance with the principles of the present invention.

Conventionally, the microprocessor 32 includes an analog-to-digital (A/D) converter 34 for receiving analog voltage input signals from, for example, the temperature sensor 30 and for providing digital output pulses or signals to a controller section 36 within the microprocessor 32. The microprocessor 32 includes a memory 38 for retaining programmed instructions for operating the control system 14 including a desired oven temperature control algorithm for controlling the operation of the oven 12, particularly during the preheat routine or mode of operation.

The control system 14 includes a power switching relay 40 having a pair of relay contacts 42 and 44 for switching power to a heating element, for example, the baking element 28, from a constant voltage (e.g. 240 volts) source 46 of alternating current electric power under the control of the controller 36. For simplification, only the baking element 28 and the power relay 40 therefore have been illustrated in FIG. 2 in the control system 14. In an actual commercial embodiment, however, additional heating elements such as the broiling element 26 could, of course, be a part of the control system 14 along with its own power switching relay to interconnected the broiling element 26 to the source 46. The broiling element 26 may used in conjunction with the heating element 28 during the BROIL mode of operation of the oven 12 and may further be used during the BAKE and CLEAN modes of the oven 12 to provide heat to the oven 12 under the control of the controller 36.

During the operation of the range 10, the baking element 28 is energized by the source 46 through the relay 40 under the control of the controller 36 to preheat and raise the temperatures of items to be cooked within the oven cavity 24 of the oven 12 in accordance with the present invention and as described further herein. The sensor 30 is typically disposed within the oven signal as an input to the AID converter 34. The analog input signal is converted to a digital output signal and is supplied to the memory 38 and the controller 36 for controlling the on-off state of the relay 40 and, therefore, the energization of the baking element 28.

As is conventional, a user of the range 10 selects, by means of the control knob 20, the desired mode of operating of the oven 12. The mode selection is provided as an input to the microprocessor 32 by a conventional mode selection circuit 20*c*. For example, if the BAKE mode of operation of the oven 12 has been selected, the user also selects a desired bake temperature by means of the control knob 22. The desired temperature is also provided as an input signal to the microprocessor 32 by a conventional desired temperature circuit 22*c*. At the initiation of the BAKE mode, the microprocessor 32 executes a preheat routine in accordance with the present invention and as described further herein. After the oven cavity 24 has reached the selected desired temperature, the microprocessor 32, through the controller 36, controls the state of the power relay 40 to energized or de-energize the baking element 28 as a function of the actual oven temperature as sensed by the sensor 30 and of the desired temperature as provided by the desired temperature circuit 22*c*.

To operate the oven 12 in the CLEAN mode, the user selects the CLEAN mode by means of control knob 22. The control system automatically operates the range through a preheat routine, in accordance with the present invention and as described further herein, to heat the oven to a desired cleaning temperature, for example 850° F., and then maintains the oven at the cleaning temperature for a predetermined period of time. Specifically, the controller 36, controls the state of the power relay 40 to energized or de-energize the baking element 28 as a function of the actual oven temperature as sensed by the sensor 30 and of the desired temperature as provided by the desired temperature circuit 22c. The oven may be operated in accordance with U.S. Pat. No. 5,571,433 during the cleaning cycle, herein incorporated by reference.

Figure 3A:
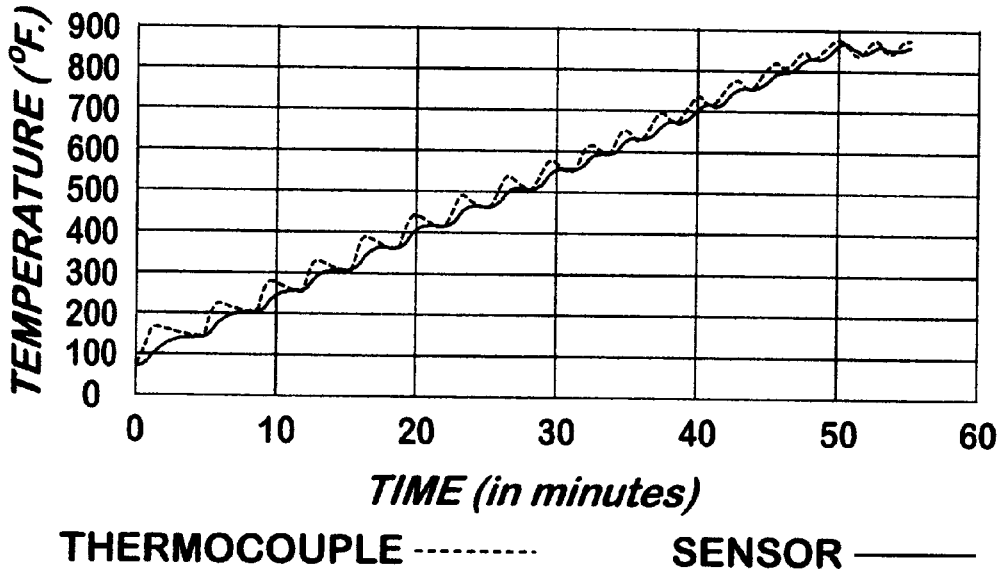
FIGS. 3*a* and 3*b* illustrate graphs of oven temperatures during preheat routines under different line voltages when the oven is operated in accordance with the principles of the present invention.
Figure 3B:
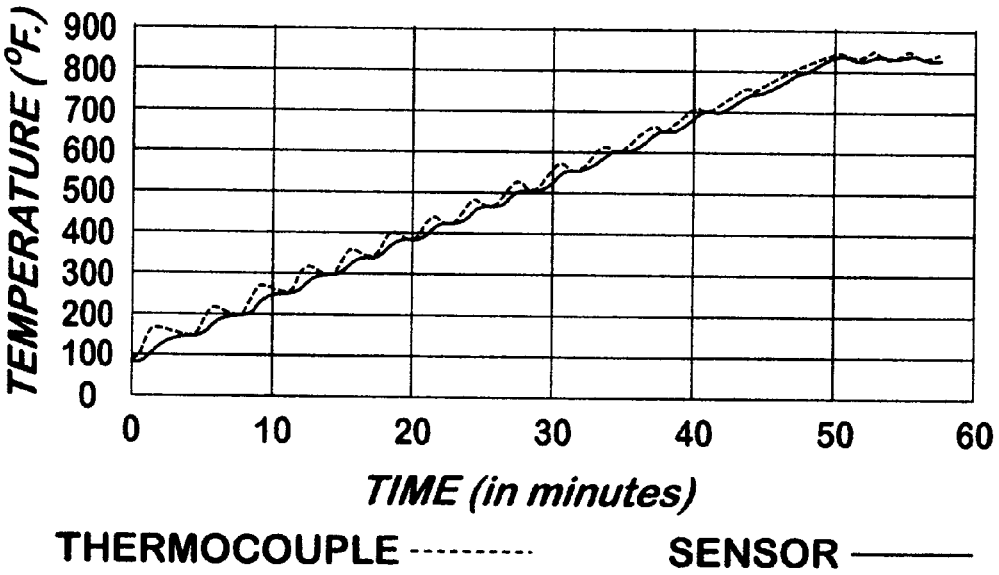

Turning now to FIGS. 3*a*, 3*b* and 4, the operation of the preheat routine can be understood. As described above, in an oven configuration utilizing a hidden oven bake element, there is a potential for undesirable porcelain crazing during the preheat portion of the oven cycle. Accordingly, it is desirable to control or limit the introduction of heat energy into the oven cavity during the preheat routine while still providing a relatively rapid preheat.

The present invention contemplates controlling the introduction of heat—or the energization of heating elements—during the preheat routine in accordance with a preselected temperature slope. In this manner, regardless of any variations in the line voltage supply, the oven cavity may be heated at a rate which is predetermined to avoid the problems of porcelain crazing.

FIGS. 3*a* and 3*b* illustrate graphically the temperature rise in an oven cavity operated in accordance with the present invention during a CLEAN mode. As shown, the final desired clean temperature in the oven is approximately 850° F. However, to avoid undesirable porcelain crazing, it is desirable to control the rise in temperature within the oven cavity 24 along a desired predetermined preheat slope. The predetermined preheat slope is selected in accordance with the particular oven configuration to provide for rapid oven cavity heating while at the same time avoiding having portions of the oven cavity experience unduly high temperatures or having the oven cavity heat too quickly.

FIGS. 3*a* and 3*b* illustrate the temperatures within an oven cavity which is preheated to CLEAN temperatures when the oven is preheated in accordance with the present invention. FIG. 3*a* shows the temperature rise during preheat when the oven is supplied with 240 V.A.C. line voltage while FIG. 3*b* shows the temperature rise in the oven cavity during the preheat routine when the oven is supplied with 208 V.A.C. line voltage. As these Figures illustrate, by controlling the temperature rise within the oven cavity to a desired predetermined preheat slope, the time to preheat the oven does not vary in response to the change in line voltage. Moreover, as shown by the linear time/temperature slope and can be understood by one skilled in the art, the present invention provides a method for controlling the preheat of an oven cavity to achieve consistent, uniform heating at a rate which does not cause undesirable combustion of porcelain crazing. The preheat slope shown in FIGS. 3*a* and 3*b* is approximately 30° F./min which results in the oven cavity reaching 850° F., assuming a starting temperature of approximately 80° F., in approximately 30 minutes. However, it can be understood that the preheat slope can be set to any value desired. For example, for a given oven configuration, it may be desirable to have a slope of approximately 18° F. /minute for a CLEAN cycle preheat routine and a slope of approximately 54° F./minute for a BAKE cycle preheat routine.

FIG. 4 illustrates a flowchart of the control logic implemented by the controller 36 in executing the preheat routine of the present invention. After the user selects an operational mode, a preheat routine 50 is initiated. The first step, shown at 52, is to set a preheat set point temperature. The preheat set point is determined based on the selected final temperature minus a predetermined off-set. The preheat set point allows for a predetermined amount of thermal overshoot during the preheating of the oven cavity 24. For example, if a CLEAN mode is selected, the selected final temperature is 850° F. and the off-set may be, for example, 75° F. Therefore, the preheat set point is 775° F. The off-set for a BAKE mode selection may be 50° F. Therefore, if the user selects a BAKE mode and selects a temperature of 400° F., the final preheat set point is 350° F.

After the preheat set point is determined, it is determined whether the Preheat routine is active, as shown in step 54. If YES, an element cycle counter (ECC) is incremented as shown in step 56. In step 58, the processor 32 queries whether the ECC is less than a desired logic loop cycle time. The cycle time may be programmed to be, for example, one minute. If the ECC is less than the desired cycle time, the controller 32 retrieves information regarding which elements are to be used for preheat, step 60. The preheat elements are then energized, shown in step 62, to begin preheating the oven cavity 24.

In step 64, a preheat cycle counter (CC) is incremented. The controller 32 then reads the current oven cavity temperature ($C_{temp}$) as measured by the temperature sensing probe 30, step 65. In step 66, the controller queries whether a preheat cycle count (PCC) is greater than a predetermined preheat cycle time (PCT). The PCT may be set at, for example, 6 seconds. If the PCC is not greater than the PCT, then the system queries whether the $C_{temp}$ is greater than the oven preheat set point, as shown in step 68. If NO, then the system loops back to step 54.

If the PCC is greater than the PCT, then the processor 32 determines whether the $C_{temp}$ is greater than the last measured temperature ($L_{temp}$), step 70. If YES, then an actual temperature slope value ($A_{slope}$) is calculated where $A_{slope}$ equals the $C_{temp}$ minus $L_{temp}$, step 72. The $A_{slope}$ is then compared to the a desired slope value ($D_{slope}$) which is set in accordance with the desired predetermined preheat slope discussed above. For example, if $A_{slope}$ is calculated every six seconds, the $D_{slope}$ is set at a value corresponding to the desired temperature rise every six seconds. IF $A_{slope}$ is larger than the desired predetermined preheat slope ($D_{slope}$), step 74, then a preheat off time counter is incremented, step 76. If $A_{slope}$ is less than $D_{slope}$, the preheat off time counter is not incremented. Accordingly, it can be understood that the preheat off time counter is only incremented when the oven cavity is experiencing a rate of heat rise greater than the desired $D_{slope}$—which may result in the undesirable effects described above. The $L_{temp}$ value is then set to equal the $C_{temp}$, step 78, and then the system queries whether the $C_{temp}$ is greater than the oven preheat set point, step 68.

The general logic, therefore, is for the controller 32 to loop through a control cycle for a predetermined cycle time—for example 1 minute. During this cycle time, the processor 32 periodically queries the temperature sensor 30 and calculates an actual temperature slope ($A_{slope}$) and compares the $A_{slope}$ to the desired predetermined preheat slope ($D_{slope}$). If the $A_{slope}$ is greater than the $D_{slope}$, then a preheat off time counter is incremented. If the $A_{slope}$ is less than the $D_{slope}$, the preheat off time counter is not incremented.

Following each cycle time, the processor 32 determines whether the preheat heating elements should be de-energized for a period of time controlled by the preheat off time counter, as shown in steps 90–102. For example, if the temperature rise within the oven cavity 24 was greater than the desired $D_{slope}$ for 30 seconds of the one minute cycle time, the preheat off time counter will be incremented five times. Following the cycle time, the preheat heating elements will be de-energized for an equivalent period of time corresponding to the preheat off time counter, i.e. 30 seconds. If, however, the preheat off time counter is equal to zero, then the preheat heating elements are not de-energized and then controller 32 loops through another control cycle.

It can be seen, therefore, that the present invention provides a unique system for preheating an oven. Although the present invention has been described with reference to specific embodiments, those of skill in the Art will recognize that changes may be made thereto without departing from the scope and spirit of the invention as set forth in the appended claims.

We claim:

1. A method for controlling the operation of an oven during the preheating period of the oven operation, the oven having an oven cavity defining an interior with at least one heating element for raising the temperature within the oven cavity and a temperature sensor for sensing the temperature within the oven cavity, the method of preheating comprising the steps of:

sensing the temperature within the oven cavity a plurality of times during the preheating period of the oven cycle;

calculating the temperature rise within the oven cavity during the preheating period; and cycling the at least one heating element on and off during the preheating period such that the temperature rise within the oven cavity during the preheating period is controlled to match a predetermined temperature rise slope.

2. The method for controlling the operation of an oven during the preheating period of the oven operation according to claim 1 further comprising the steps of:

cycling the at least one heating element on and off during the preheating period to prevent the temperature rise within the oven cavity from exceeding the predetermined temperature rise slope.

3. The method for controlling the operation of an oven during the preheating period of the oven operation according to claim 1 further comprising the steps of:

sensing the temperature within the oven cavity to determine a first temperature within the oven cavity during the preheating period;

sensing the temperature within the oven cavity to determine a second temperature within the oven cavity a predetermined time following the first temperature measurement;

calculating an actual slope value corresponding to the difference between the second temperature and the first temperature;

comparing the calculated actual slope value to a predetermined desired slope value corresponding to the predetermined temperature rise slope; and de-energizing the at least one heating element if the calculated value is greater than the predetermined desired slope value.

4. The method for controlling the operation of an oven during the preheating period of the oven operation according to claim 1 further comprising the steps of:

(1) sensing the temperature within the oven cavity to determine a first temperature within the oven cavity during the preheating period;

(2) sensing the temperature within the oven cavity to determine a second temperature within the oven cavity a predetermined time following the first temperature measurement;

(3) calculating an actual slope value corresponding to the difference between the second temperature and the first temperature;

(4) comparing the calculated actual slope value to a predetermined desired slope value corresponding to the predetermined temperature rise slope;

(5) incrementing an off-time counter if the calculated actual slope value is greater than the desired slope value;

repeating steps (1)–(5) a predetermined number of times; and de-energizing the at least one heating element for a period of time corresponding to the value of the off-time counter.

5. A method for controlling the operation of an oven during the preheating period of the oven operation, the oven having an oven cavity defining an interior with at least one heating element for raising the temperature within the oven cavity and a temperature sensor for sensing the temperature within the oven cavity, the method of preheating comprising the steps of:

sensing the temperature within the oven cavity a plurality of times during the preheating period of the oven cycle;

calculating the temperature rise within the oven cavity during the preheating period; and cycling the at least one heating element on and off during the preheating period to prevent the temperature rise within the oven cavity from exceeding a predetermined temperature rise slope.

6. The method for controlling the operation of an oven during the preheating period of the oven operation according to claim 5 further comprising the steps of:

cycling the at least one heating element on and off during the preheating period such that the temperature rise within the oven cavity during the preheating period is controlled to match the predetermined temperature rise slope.

7. The method for controlling the operation of an oven during the preheating period of the oven operation according to claim 5 further comprising the steps of:

sensing the temperature within the oven cavity to determine a first temperature within the oven cavity during the preheating period;

sensing the temperature within the oven cavity to determine a second temperature within the oven cavity a predetermined time following the first temperature measurement;

calculating an actual slope value corresponding to the difference between the second temperature and the first temperature;

comparing the calculated actual slope value to a predetermined desired slope value corresponding to the predetermined temperature rise slope; and de-energizing the at least one heating element if the calculated value is greater than the predetermined desired slope value.

8. A method for controlling the operation of an oven during the preheating period of the oven operation, the oven having an oven cavity defining an interior with at least one heating element for raising the temperature within the oven cavity and a temperature sensor for sensing the temperature within the oven cavity, the method of preheating comprising the steps of:

sensing the temperature within the oven cavity a plurality of times during the preheating period of the oven cycle;

calculating the temperature rise within the oven cavity during the preheating period; and to controlling the energization of the at least one heating element on and off during the preheating period such that the temperature rise within the oven cavity during the preheating period matches a predetermnined temperature rise slope.

* * * * *